US010713878B2

(12) United States Patent
Roekens et al.

(10) Patent No.: US 10,713,878 B2
(45) Date of Patent: Jul. 14, 2020

(54) INTAKE MECHANISM FOR A MERCHANDISER

(71) Applicant: THE COCA-COLA COMPANY, Atlanta, GA (US)

(72) Inventors: Jurgen Roekens, Kampenhout (BE); Jacobus P. M. Dessing, Hoofddorp (NL)

(73) Assignee: THE COCA-COLA COMPANY, Atlanta, GA (US)

( * ) Notice: Subject to any disclaimer, the term of this patent is extended or adjusted under 35 U.S.C. 154(b) by 0 days.

(21) Appl. No.: 15/565,228

(22) PCT Filed: Apr. 1, 2016

(86) PCT No.: PCT/US2016/025571
§ 371 (c)(1),
(2) Date: Oct. 9, 2017

(87) PCT Pub. No.: WO2016/164267
PCT Pub. Date: Oct. 13, 2016

(65) Prior Publication Data

US 2018/0061170 A1 Mar. 1, 2018

Related U.S. Application Data

(60) Provisional application No. 62/144,971, filed on Apr. 9, 2015.

(51) Int. Cl.

| | |
|---|---|
| ***G07F 11/18*** | (2006.01) |
| ***G07F 9/10*** | (2006.01) |
| ***G07F 7/06*** | (2006.01) |

(52) U.S. Cl.
CPC ..... *G07F 11/18* (2013.01); *G07F 7/0609* (2013.01); *G07F 9/10* (2013.01); *G07F 9/105* (2013.01)

(58) Field of Classification Search
CPC ..... G07F 7/0609; G07F 9/10; G07F 9/105; G07F 11/18; G07F 17/0014
See application file for complete search history.

(56) References Cited

U.S. PATENT DOCUMENTS

| | | | | |
|---|---|---|---|---|
| 9,953,480 | B2 * | 4/2018 | Roekens | G07F 9/105 |
| 2007/0170179 | A1 * | 7/2007 | Segiet | G07F 9/105 219/679 |

(Continued)

FOREIGN PATENT DOCUMENTS

| | | | |
|---|---|---|---|
| KR | 20120052545 | A | 5/2012 |
| KR | 1020120052545 | A | 5/2012 |

OTHER PUBLICATIONS

Kang, Min Jeong, International Search Report and Written Opinion for PCT/US2016/025571; dated Jul. 14, 2016; Korean Intellectual Property Office, Daejeon Metropolitan City, Republic of Korea.

(Continued)

*Primary Examiner* — Gene O Crawford
*Assistant Examiner* — Kelvin L Randall, Jr.

(57) ABSTRACT

The present application provides an intake mechanism for a product into a merchandiser. The intake mechanism may include an input tray, a reciprocating assembly to maneuver the input tray, an identification module, and an input control system. The input control system permits access to the merchandiser as the input tray is maneuvered by the reciprocating assembly if the product is identified by the identification module.

10 Claims, 11 Drawing Sheets

(56) References Cited

U.S. PATENT DOCUMENTS

| | | | | |
|---|---|---|---|---|
| 2008/0245820 | A1 | 10/2008 | Pfister et al. | |
| 2009/0166149 | A1* | 7/2009 | Horniak | G07F 7/0609 193/31 R |
| 2011/0284569 | A1 | 11/2011 | Howell et al. | |
| 2012/0310407 | A1 | 12/2012 | De La Rue et al. | |
| 2013/0112702 | A1* | 5/2013 | Roekens | A47F 3/0486 221/1 |

OTHER PUBLICATIONS

Moynihan, Maurice; European Search Report; dated Aug. 27, 2018; pp. 1-6; European Patent Office, The Hague, Netherlands.

* cited by examiner

INTAKE MECHANISM FOR A MERCHANDISER

RELATED APPLICATIONS

This application is a National Stage Patent Application and claims priority to and the benefit of PCT International Patent Application Number PCT/US2016/025571, filed Apr. 1, 2016, which claims priority to and the benefit of U.S. Provisional Application No. 62/144,971, filed Apr. 9, 2015, both of which are hereby incorporated by reference in their entirety.

TECHNICAL FIELD

The present application and the resultant patent relate generally to merchandisers such as coolers and other types of product dispensers and more particularly relate to a merchandiser with a manual intake mechanism for receiving an ambient product and the like and for identifying the product.

BACKGROUND OF THE INVENTION

Generally described, a merchandiser such as an open front cooler may include a refrigerated open enclosure with a number of chilled products within the reach of a consumer. Because open front coolers offer such quick and easy access and proximity to the chilled products therein, such coolers often spur impulse purchases by consumers. As a result, open front coolers may provide an increase in sales volume as compared to a conventional glass door merchandiser and the like having the same size and/or in similar locations. An open front cooler also may provide an increase in sales volume as compared to similar products stored at ambient temperatures on conventional product shelves or elsewhere.

One drawback with conventional open front coolers, however, is that the cooler may consume several times more energy as compared to a glass door merchandiser of the same size due to the lack of a door or other type of insulated front space to keep the cold air from escaping. The increased sales revenue generally provided by the open front cooler thus may not cover or justify the resulting increase in energy costs.

There is thus a desire for an improved cooler, merchandiser, and the like that promotes impulse purchases with easy accessibility such as in an open front cooler but with the improved efficiency and the reduced energy costs of a glass door merchandiser and the like. The merchandiser thus may dispense a temperature controlled product upon receipt of an ambient product.

SUMMARY OF THE INVENTION

The present application and the resultant patent thus provide an intake mechanism for a product into a merchandiser. The intake mechanism may include an input tray, a reciprocating assembly to maneuver the input tray, an identification module, and an input control system. The input control system permits access to the merchandiser as the input tray is maneuvered by the reciprocating assembly if the product is identified by the identification module.

The present application and the resultant patent further provide a method of intaking a product into a merchandiser. The method may include the steps of receiving the product in an input tray, identifying the product, receiving a force that maneuvers the input tray, and using the force to open a refrigerator flap if the product is identified or displacing the force if the product is not identified such that the refrigerator flap is not opened.

The present application and the resultant patent further include a merchandiser for a number of products. The merchandiser may include a temperature controlled compartment and a manual intake mechanism. The manual intake mechanism may include an input tray, an identification module, and an input control system. The input control system permits access to the merchandiser as the input tray is maneuvered if the product is identified by the identification module.

These and other features and improvements of the present application and the resultant patent will become apparent to one of ordinary skill in the art upon review of the following detailed description when taken in conjunction with the several drawings and the appended claims.

DETAILED DESCRIPTION

The present application concerns the offer for sale or other use of any type or number of products 10. Although the products 10 are shown, by way of example only, in the form of bottles, it is understood that the products 10 may include any type or size of container including, but not limited to, bottles, cans, pouches, boxes, wrapped items, and/or any type of rigid or flexible packaging. The products 10 may include beverages, food items, non-food items, consumer products, and/or any type of product 10 that may be positioned on a shelf and/or that may be vended. Similarly, while one use herein is for a chilled product 10, it will be understood that the products 10 herein may be at ambient, refrigerated, frozen, heated, or at any desired temperature or state. As will be described in more detail below, the products 10 herein may take the form of ambient products 20 and temperature controlled products 30. The ambient products 20 and the temperature controlled products 30 may or may not be the same products 10. Other product variations may be used herein. The scope of this application and the claims herein are in no way limited by the nature of the products 10 intended to be used herein.

Figure 1:
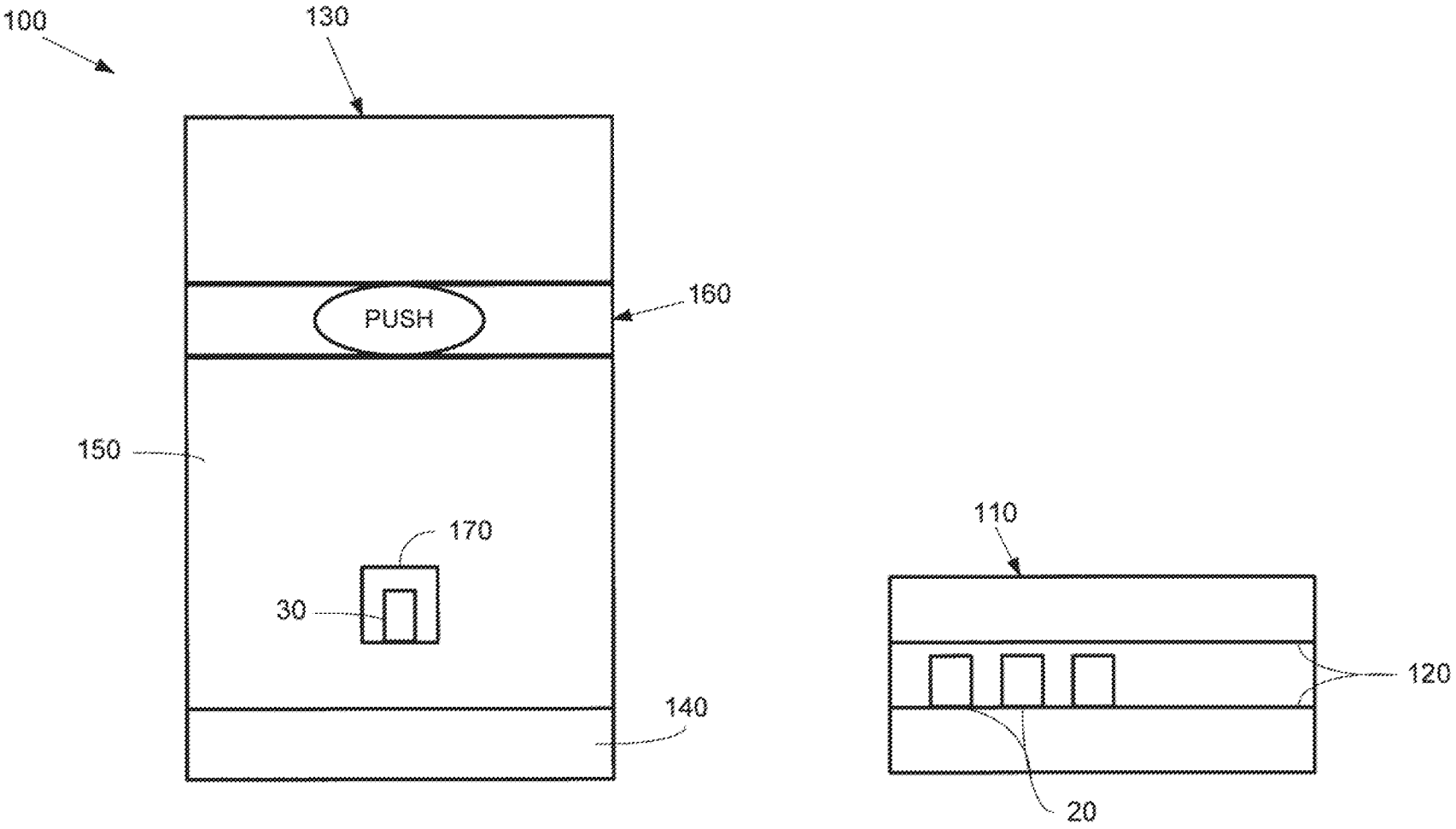
FIG. 1 is a schematic diagram of a merchandiser with an intake mechanism as may be described herein.
Figure 2A:
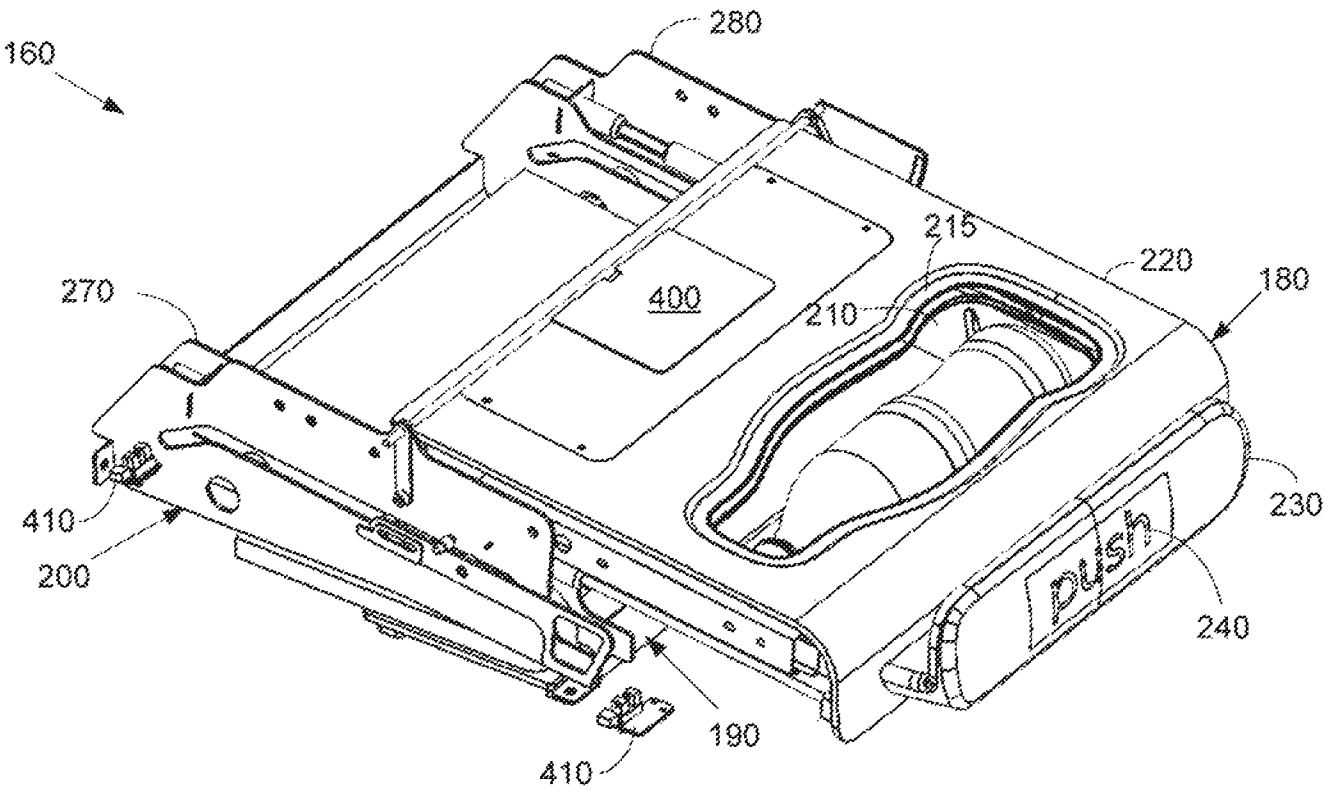
FIG. 2A is a perspective view of an example of the intake mechanism as may be used with the merchandiser of FIG. 1.
Figure 2B:
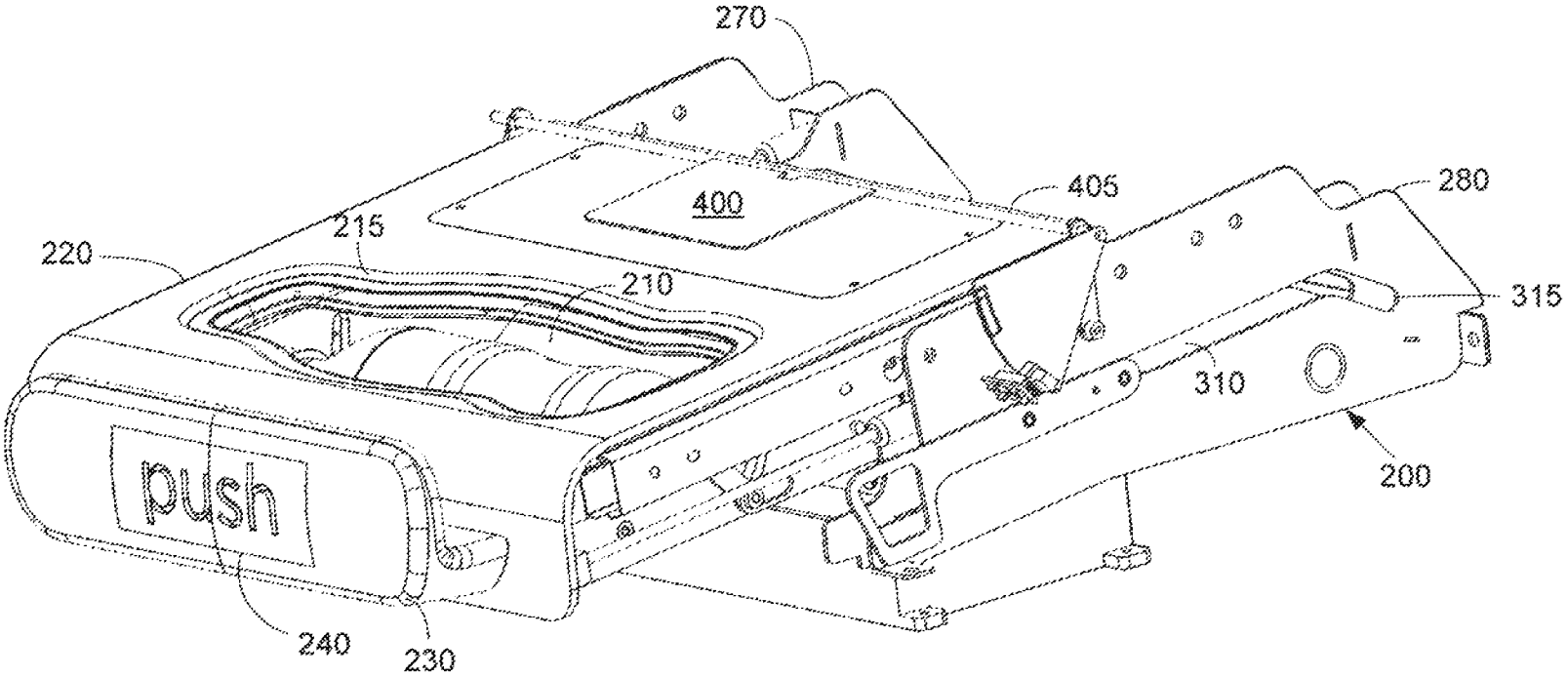
FIG. 2B is a further perspective view of an example of the intake mechanism as may be used with the merchandiser of FIG. 1.

Referring now to the drawings, in which like numerals refer to like elements throughout the several views, FIGS. 1, 2A, and 2B show a merchandiser as may be described herein. The merchandiser 100 may include one or more open or ambient compartments 110. Each ambient compartment 110 may include a number of open or ambient compartment shelves 120. Any number of the ambient compartment shelves 120 may be used. The ambient compartment 110 and the ambient compartment shelves 120 may have any suitable size, shape, or configuration. Any number of the products 10 may be placed on the ambient compartment shelves 120. The ambient compartment shelves 120 may be flat or may be any type of structure that supports the products 10 such as angled shelves, gravity fed shelves, neck tracker tubes, product chutes, and the like. Likewise, vertical columns and conventional vending columns may be used. At least the front of the ambient compartment 110 may be open to allow for substantially unimpeded access to the products 10 on the ambient compartment shelves 120. The ambient compartment 110 and the products 20 therein may be maintained at an ambient temperature. Part or all of the ambient compartment 110, however, may be heated, cooled, or otherwise temperature controlled on an intermittent or a temporary basis. Other components and other configurations may be used herein.

The merchandiser 100 also may include a temperature controlled compartment 130. The temperature controlled compartment 130 may be substantially enclosed and/or insulated. Although the temperature controlled compartment 130 shown in FIG. 1 is a standalone unit with respect to the ambient compartment 110, the compartments 110, 120 may be integral or otherwise arranged. The temperature controlled compartment 130 may be at any desired temperature from freezing, chilled, ambient, warm, or hot. The temperature controlled compartment 130 may be in communication with a convention heating/cooling module 140 and the like. Other components and other configurations may be used herein.

The merchandiser 100 may include an internal dispensing mechanism 150 positioned within the temperature controlled compartment 130. The internal dispensing mechanism 150 may receive an ambient product 20 and the like and dispense a temperature controlled product 30 and the like. The internal dispensing mechanism 150 may take many different configurations. Examples of different types of internal dispensing mechanisms may be shown in commonly owned U.S. Pat. No. 8,757,434 B2, entitled "Merchandiser"; U.S. Patent Publication No. 2012/0000927 A1, entitled "Merchandiser"; U.S. Patent Publication No. 2013/0112702 A1, entitled "Merchandiser"; U.S. Patent Publication No. 2014/0246452 A1, entitled "Merchandiser"; U.S. Provisional Application Ser. No. 61/919,894, filed on Dec. 23, 2013, entitled "Merchandiser with Product Dispensing Chute Mechanism"; and PCT Application No. PCT/US2014/72014, entitled "Merchandiser with Product Dispensing Chute Mechanism" filed on Dec. 23, 2014. Each of these patents, publications, and applications are incorporated herein by reference in full.

The temperature controlled compartment 130 of the merchandiser 100 also may include an intake mechanism 160 and a dispensing port 170. The intake mechanism 160 and the dispensing port 170 may be in communication with the internal dispensing mechanism 150 to receive an ambient product 20 and dispense a temperature controlled product 30. Any number of the intake mechanisms 160 and the dispensing ports 170 may be used herein. Other components and other configurations may be used herein.

FIGS. 2A, 2B, 3, 4A, and 4B show an example of the intake mechanism 160. The intake mechanism 160 may be positioned on top of or otherwise adjacent to the temperature controlled compartment 130 or elsewhere. Generally described, the input mechanism may include an input tray 180 moveably mounted about a base 190. The input tray 180 may maneuver about the base 190 via a reciprocating spring assembly 200. Alternatively, the input tray 180 may be secured directly to the temperature controlled compartment 130 or elsewhere. Other components and other configurations may be used herein.

The input tray 180 of the intake mechanism 160 may include an input port 210. The input port 210 may be sized and configured so as to accommodate the intended product 10 to be used therein. The input port 210 may have any suitable size, shape, or configuration. The input port 210 may be surrounded by one or more lights 215. In this example, one or more lighting emitting diodes may be used. The lights 215 may use any type of colors and/or brightness in any suitable size, shape, or configuration. The input port 210 may be positioned within an outer frame 220. The outer frame 220 may have any suitable size, shape, or configuration. The input tray 180 may include a push handle 230 or other type of structure thereon. The push handle 230 may be a separate structure extending from the input tray 180 or the push handle 230 may be integral therewith. The push handle 230 may have any suitable size, shape, or configuration. An instruction 240 such as "PUSH" may be positioned thereon. Any other type of instruction, indicia, or design may be used herein. The input tray 180 may be positioned at a slight angle to ensure that the tray 180 may fall by gravity to a starting position. The angle may range from about one (1) to about twenty-five (25) degrees. Other angles may be used herein. Other components and other configurations may be used herein.

Figure 3:
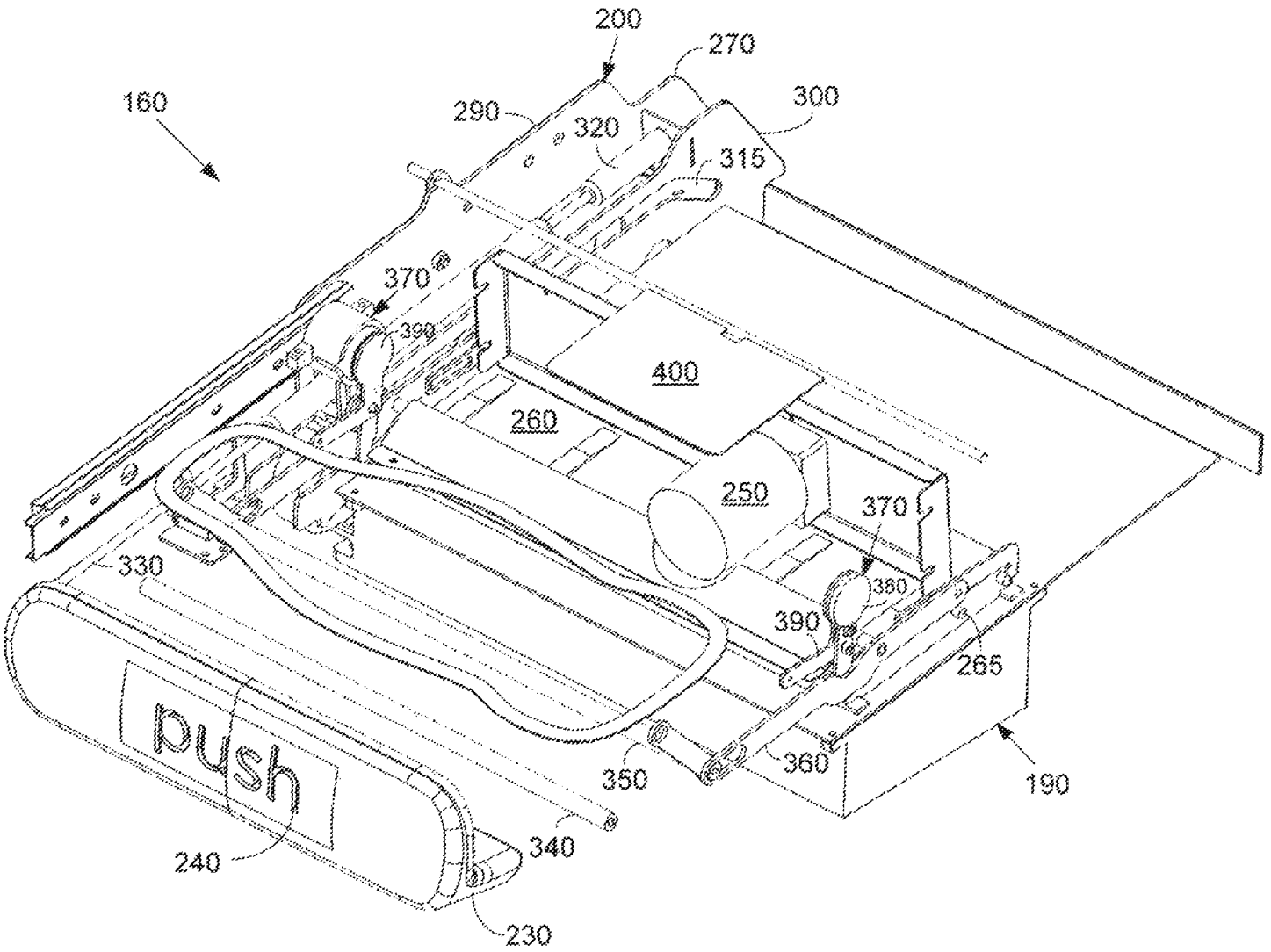
FIG. 3 is a further perspective view of the internal components of the intake mechanism of FIG. 2A.

FIG. 3 shows the intake mechanism 160 with the outer frame 220 removed. As is shown, the intake mechanism 160 may include an identification module 250 positioned adjacent to the input port 210. The identification module 250 may include an optical recognition device, a barcode scanner, a RFID tag reader, photoelectric cells, and/or any type of device that may read indicia on the product 10, identify the shape of the product 10, or otherwise identify or receive the identity of the product 10. For example, a camera may read the label or other indicia on the product 10 for identification. Alternatively, a liquid level in a bottle, the color of the fluid within the bottle, cap color, or other types of indicia may be used.

The base 190 of the intake mechanism 160 may include a refrigerator flap 260 positioned thereon. The refrigerator flap 260 may enclosed a refrigerator port 195. The refrigerator flap 260 may provide entry into the internal dispensing mechanism 150 of the temperature controlled compartment 130 via the refrigerator port 195. The refrigerator flap 260 may be an open and shut type door that may swing, slide, or otherwise open and close. The refrigerator flap 260 may have one or more bosses 265 extending from one or more sides thereof. The refrigerator flap 260 and the bosses 265 may have any suitable size, shape, or configuration. Other components and other configurations may be used herein.

Figure 4A:
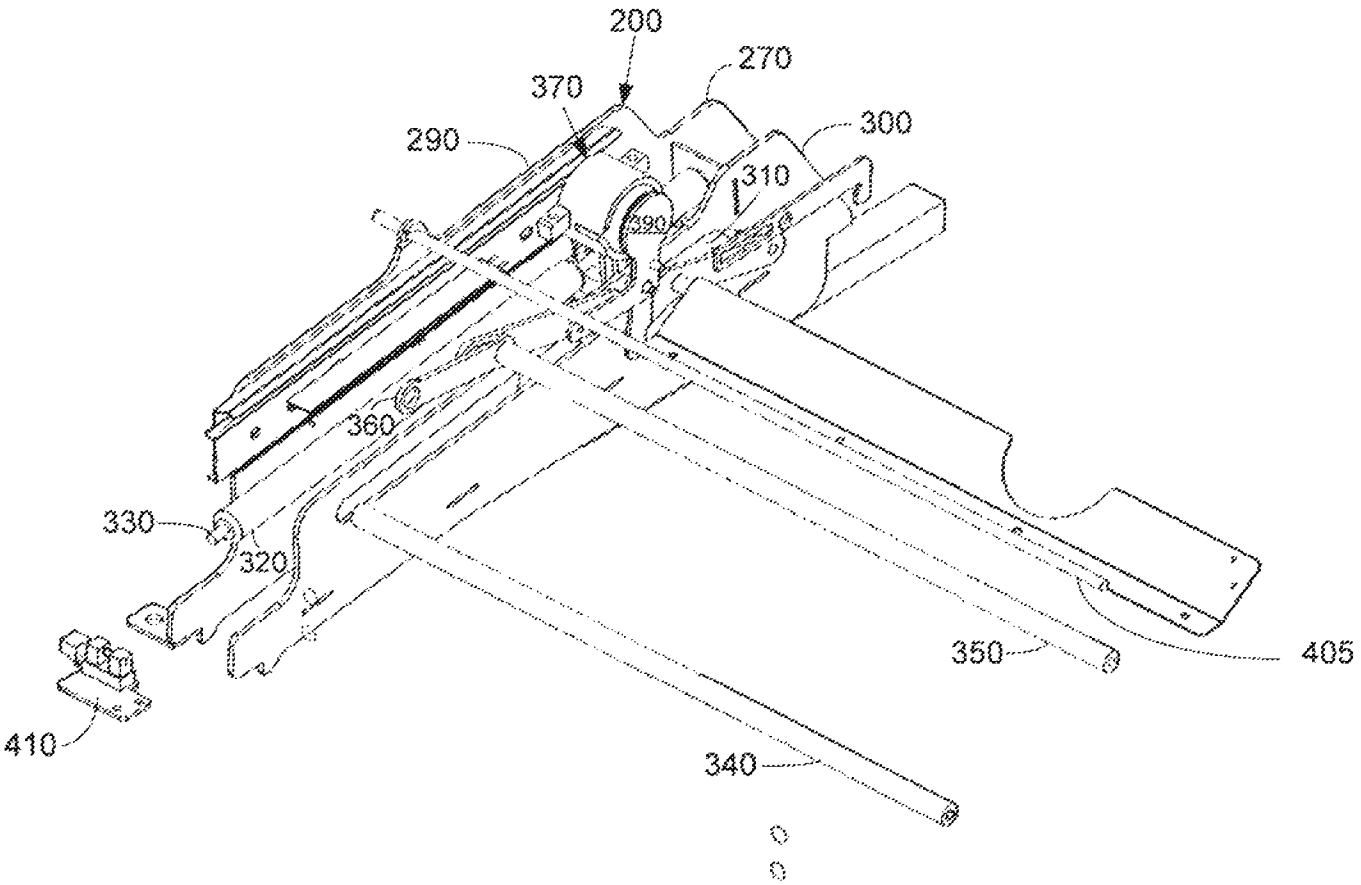
FIG. 4A is a further perspective view of the internal components of the intake mechanism of FIG. 2A.
Figure 4B:
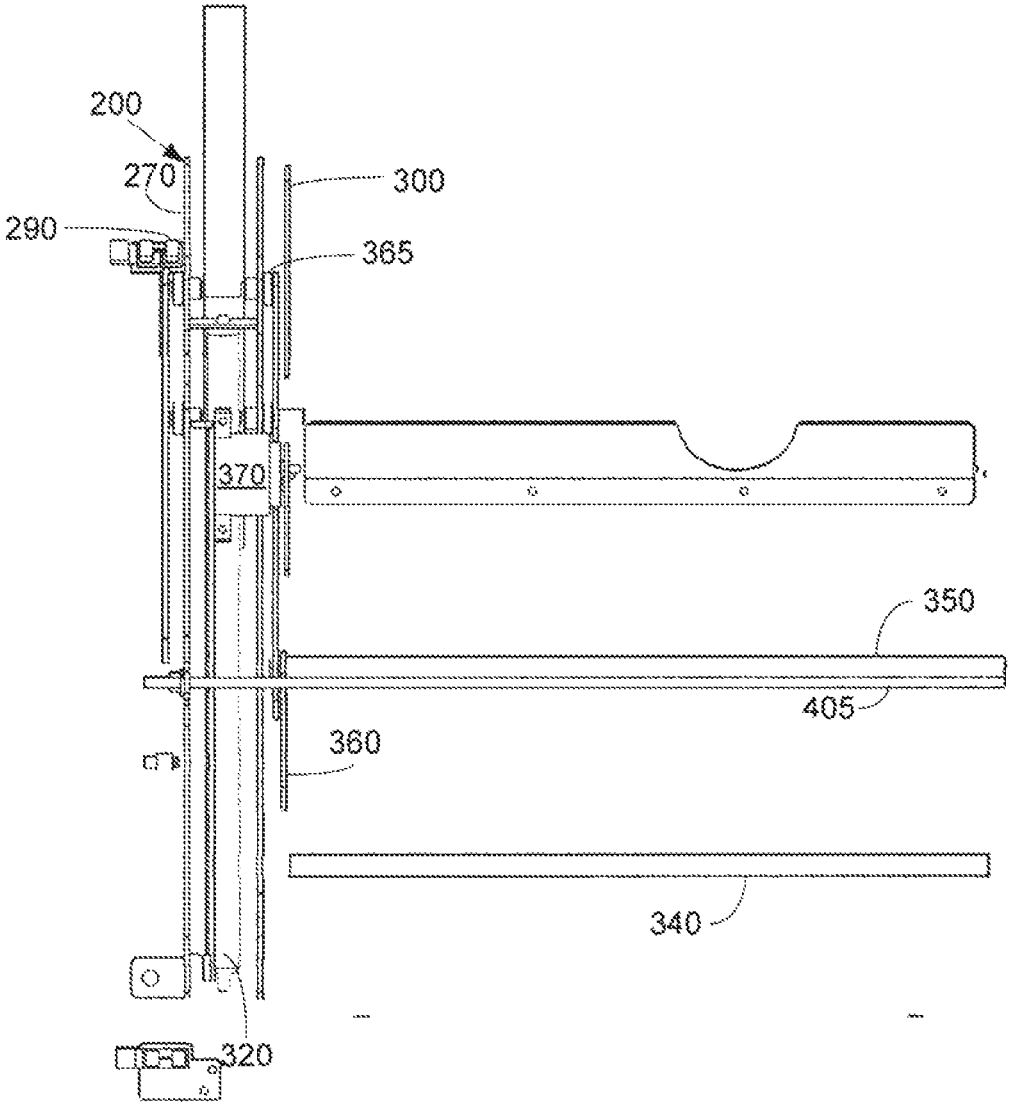
FIG. 4B is a further perspective view of the internal components of the intake mechanism of FIG. 2A.

FIGS. 3, 4A, and 4B show portions of the reciprocating spring assembly 200. The reciprocating spring assembly 200 may include a first side 270 and a second side 280. For clarity, only the first side 270 is completely shown with the second side 280 being substantially identical. Both sides 270, 280 of the reciprocating spring assembly 200 may have a pair of frame members, a first frame member 290 and a second frame member 300. The frame members 290, 300 may have any number of frame member slots 310 positioned therein. The slots 310 may have a downward dip 315 at a back end thereof. The frame members 290, 300 may be secured to the base 190, to the temperature controlled compartment 130, or elsewhere.

A gas spring 320 may be positioned within the frame members 290, 300. The gas spring 320 may include a piston 330 attached to the outer frame 220 or the push handle 230 of the input tray 180 for movement therewith. The gas spring 320 may provide for smooth and steady in and out motion. The gas spring 320 may be of conventional design. Any type of reciprocating motion device may be used herein. Other components and other configurations may be used herein.

The reciprocating spring assembly 200 also may include a number of input rods, a first input rod 340 and a second input rod 350. The input rods 340, 350 may extend between the frame members 270, 280. One or both of the input rods 340, 350 may swivel therein. The input rods 340, 350 may be sized to accept and carry a product 10 therein. One or more of the input rods 340, 350 may be connected to one or more input rod linkages 360. The input rod linkages 360 may have any suitable size, shape, or configuration. The input rod linkages 360 may be mounted on the frame members 290, 300 for movement thereon. Specifically, the input rod linkages 360 may ride within the slots 310 of the frame members 290, 300 via one or more rollers 365. The input rod linkages 360 in turn may pivot in any direction about one or more pivot points. As the input rod linkages 360 are force along the downward dip 315 in the slots 310 via the gas spring 320, at least the input rod 350 is swiveled backward so as to separate the input rods 340, 350.

The input rod linkages 360 may be positioned adjacent to an input control device 370. The input control device 370 may include a magnet 380 and a pawl 390 or other type of linkage. When the magnet 380 of the input control device 370 is on or activated, the pawl 390 remains engaged and may come in contact with the boss 265 of the refrigerator flap 260 for movement therewith. If the magnet 380 is not on or activated, the pawl 390 may be pivotable such that the boss 265 of the refrigerator flap 260 may pass thereby without engagement. Alternatively, the input control device 370 may deactivate the magnet 380 upon recognizing an authorize product 10 so as to maintain the pawl 390 in an engaged position and activated the magnet 380 to position the pawl 390 in a non-engaged position if the product 10 is not identified. Other types of control schemes may be used herein. Other components and other configurations also may be used herein.

Other types of rods and linkages may be used herein. For example, a trigger flap 400 and rod 405 may extend between the frame members 290, 300. The trigger flap 400 may be positioned about the refrigerator flap 260. The trigger flap 400 may determine when the product 10 has fallen through the refrigerator port 195. This determination may trigger the internal dispensing mechanism 150. A number of position sensors 410 also may be positioned the input tray 180 so as to determine the position of the input tray 180 and/or the refrigerator flap 260. The position sensors 410 may be conventional contact or non-contact sensors. Other components and other configurations may be used herein.

Alternatively, a motorized version also may be used herein in whole or in part. Specifically, the gas spring 330 may be replaced with an electro-mechanical device to actively pull and push the various input rods and linkages. For example, a stepper motor and screw, a linear actuator, and the like may be used. The intake mechanism 160 thus may be trigger by a push as in a conventional compact disc player. Other triggers may include push bottom and the like.

Figure 5:
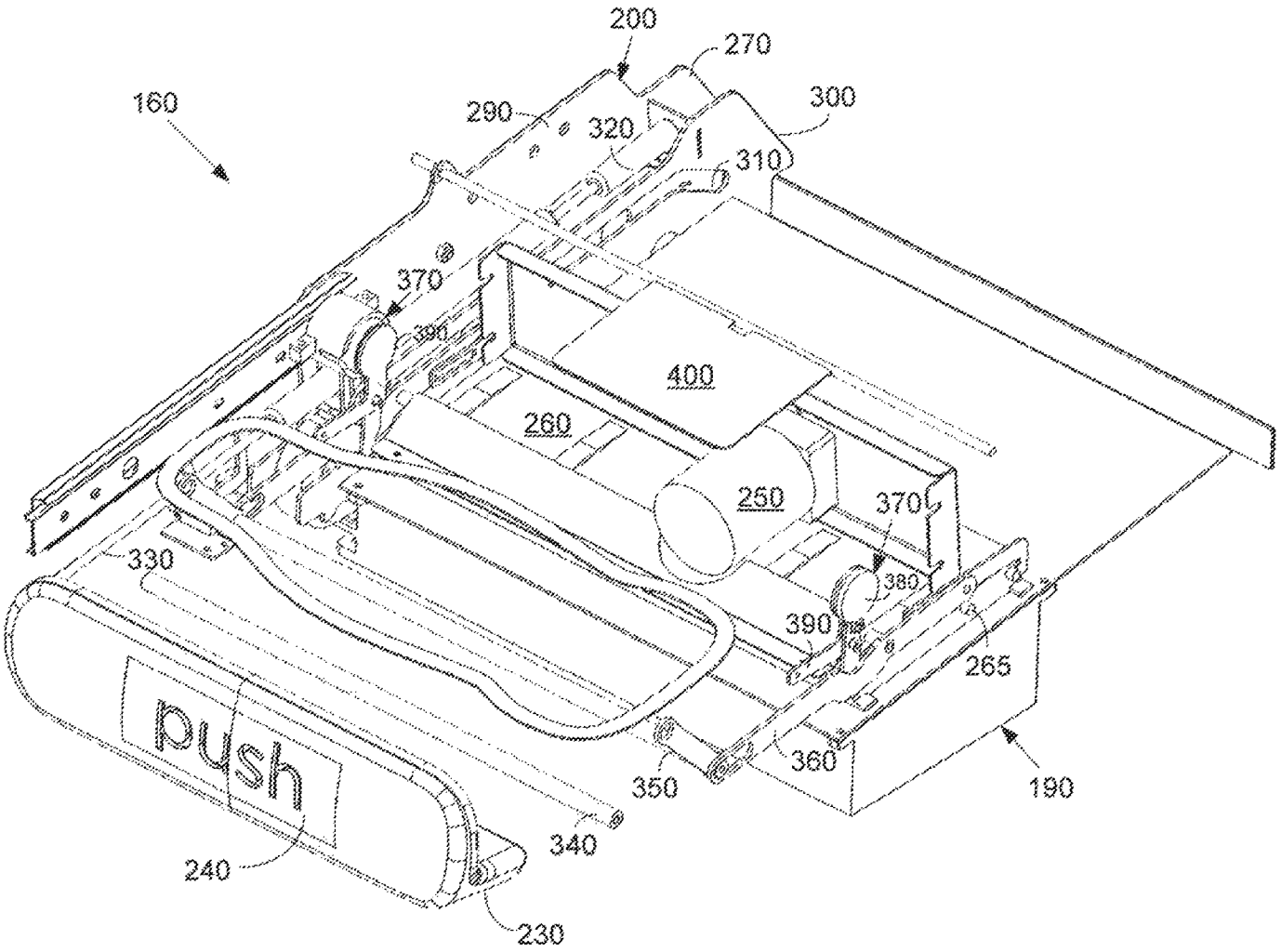
FIG. 5 is a partial perspective view of the intake mechanism of FIG. 2A in a "ready" mode.

FIGS. 5-9 show examples of the use of the intake mechanism 160. In FIG. 5, the intake mechanism 160 is in a "ready" mode. The gas spring 320 of the reciprocating spring assembly 200 is in its fully extended position. The refrigerator flap 260 is closed. The input rods 340, 350 are positioned underneath the input port 210 and ready to receive the product 10.

Figure 6:
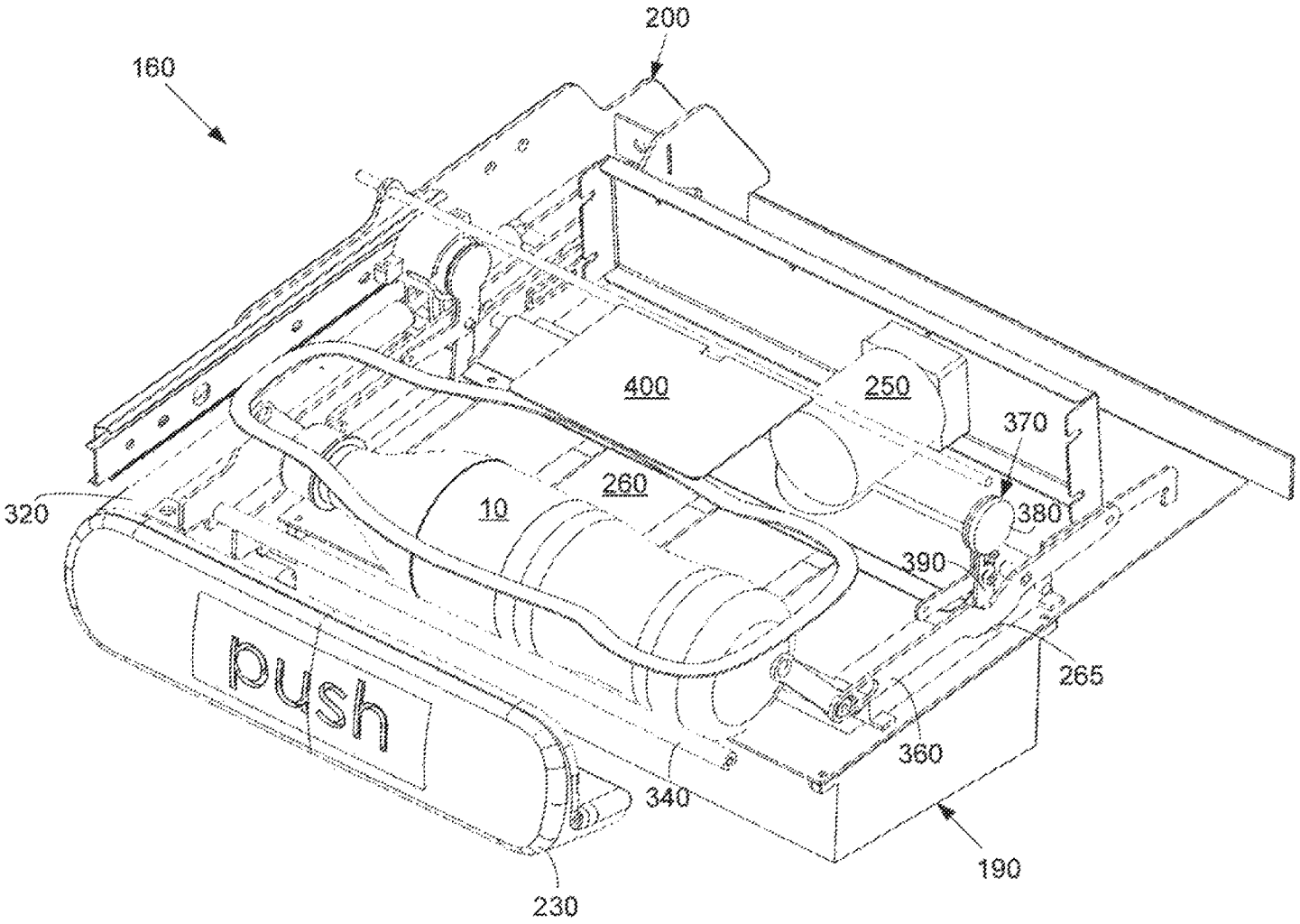
FIG. 6 is a partial perspective view of the intake mechanism of FIG. 2A in a "mid-acceptance" mode.

FIG. 6 shows the intake mechanism 160 in a "mid-acceptance" mode. In this mode, the product 10 has been positioned within the input port 210 on the input rods 340, 350. The identification module 250 identifies the product 10 as an authorized product 10. Once so identified, the magnet 380 of the input control device 370 thus forces the pawl 390 into a locking position. The user then pushes the input tray 180 by the push handle 230 or otherwise. The reciprocating spring assembly 200 carries the product 10 within the input rods 340, 350 via the input rod linkages 360. The input rod linkages 360 also carry the input control device 370, the identification module 250, and the like. The pawl 390 then engages the boss 265 and begins to slid open the refrigerator flap 260.

Figure 7:
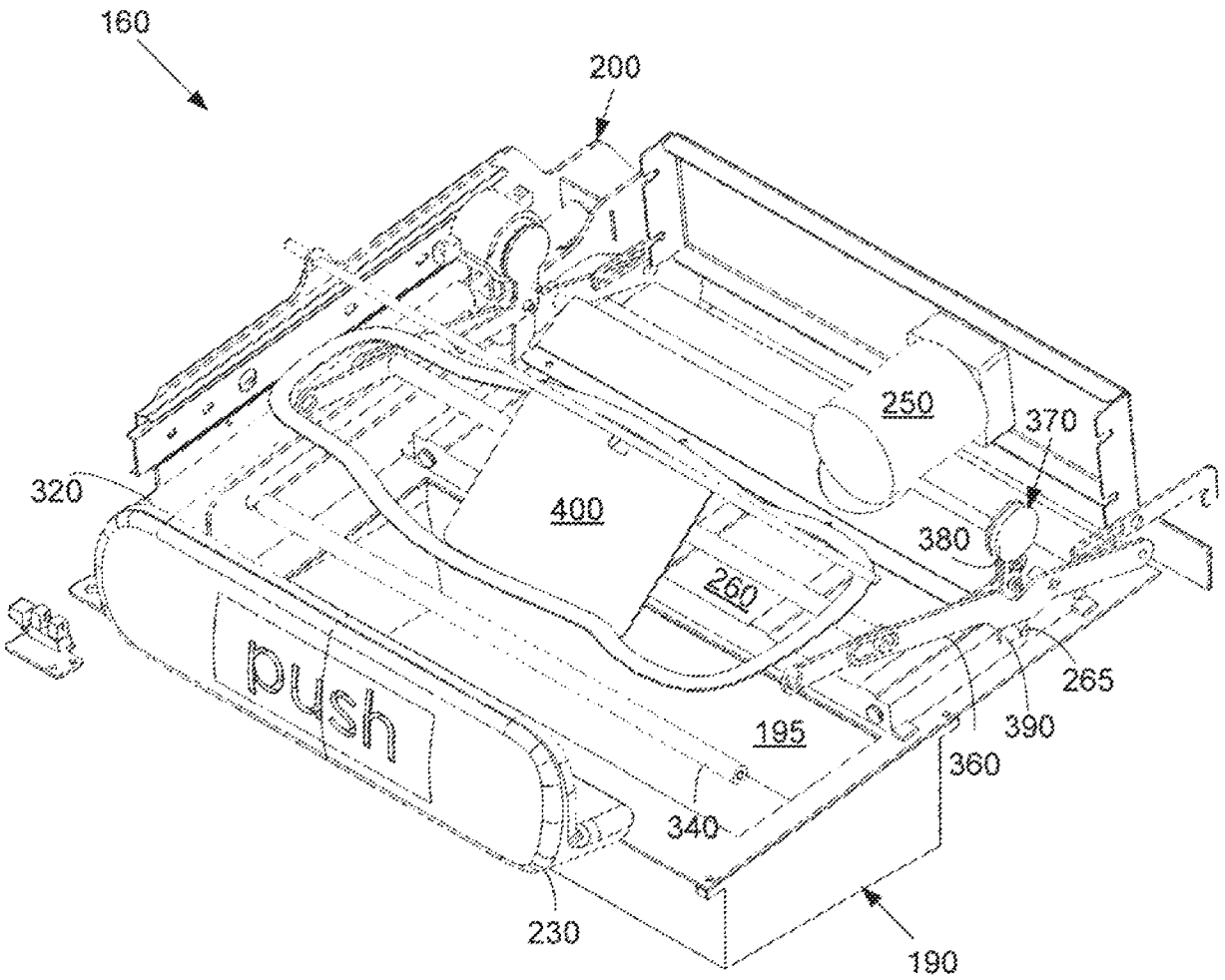
FIG. 7 is a partial perspective view of the intake mechanism of FIG. 2A in a "release" mode.

FIG. 7 shows the intake mechanism 160 in a "release" mode. As the user compresses the reciprocating spring assembly 200, the pawl 390 of the input control device 370 continues to slide the refrigerator flap 260 to the open position. Likewise, the input rod linkages 360 pull one or both of the input rods 340, 350 apart such that the product 10 may fall through the open refrigerator flap 260 into the internal dispensing mechanism 150 of the temperature controlled compartment 130 via the refrigerator port 195. Once the consumer releases the push handle 230, the reciprocating spring assembly 200 again may force the input tray 180 back into the "ready" mode to accept the next product 10. The position sensors 410 may determine when the intake mechanism 160 is in the release mode and/or the ready mode.

Figure 8:
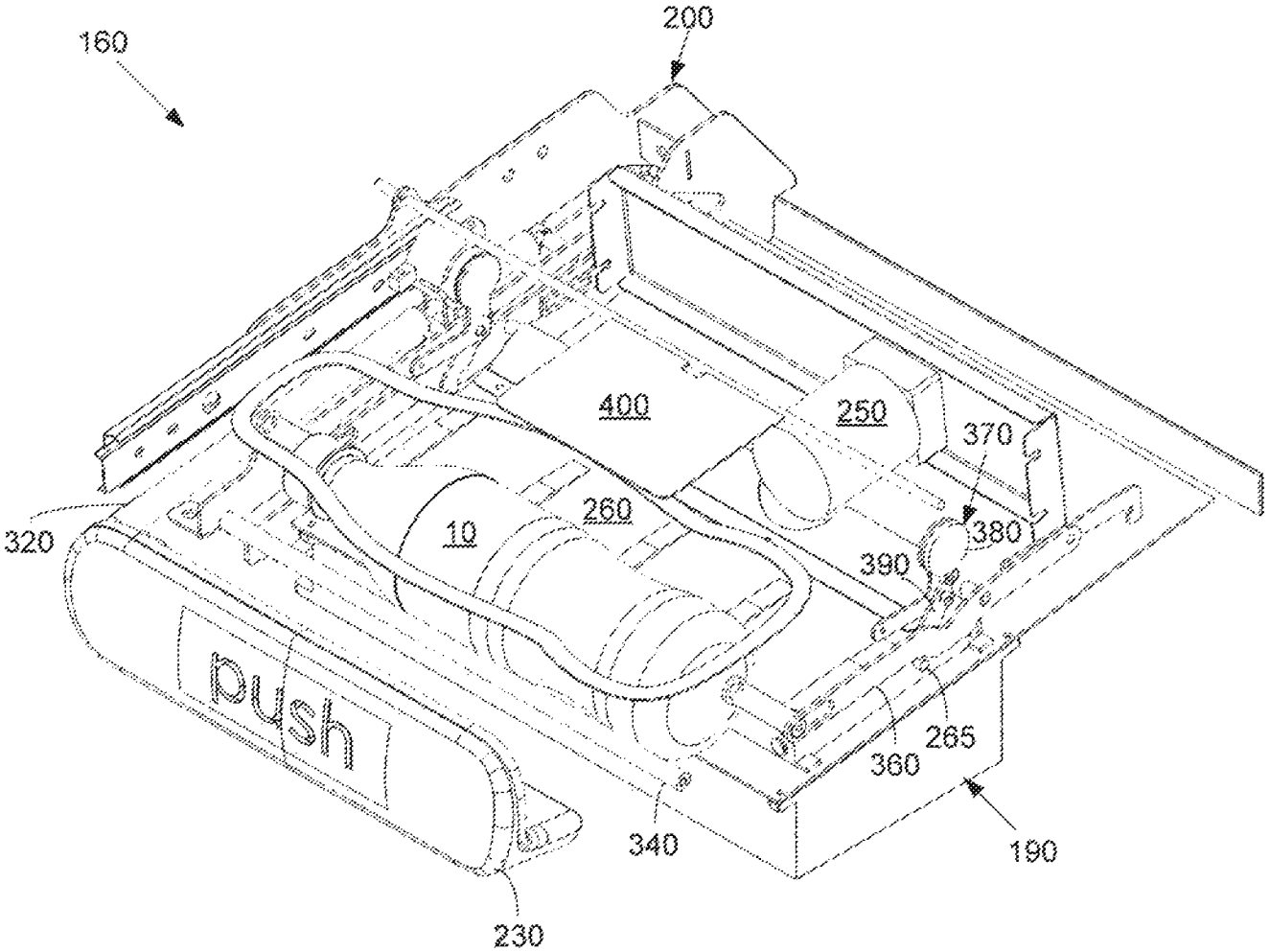
FIG. 8 is a partial perspective view of the intake mechanism of FIG. 2A in a "mid-reject" mode.
Figure 9:
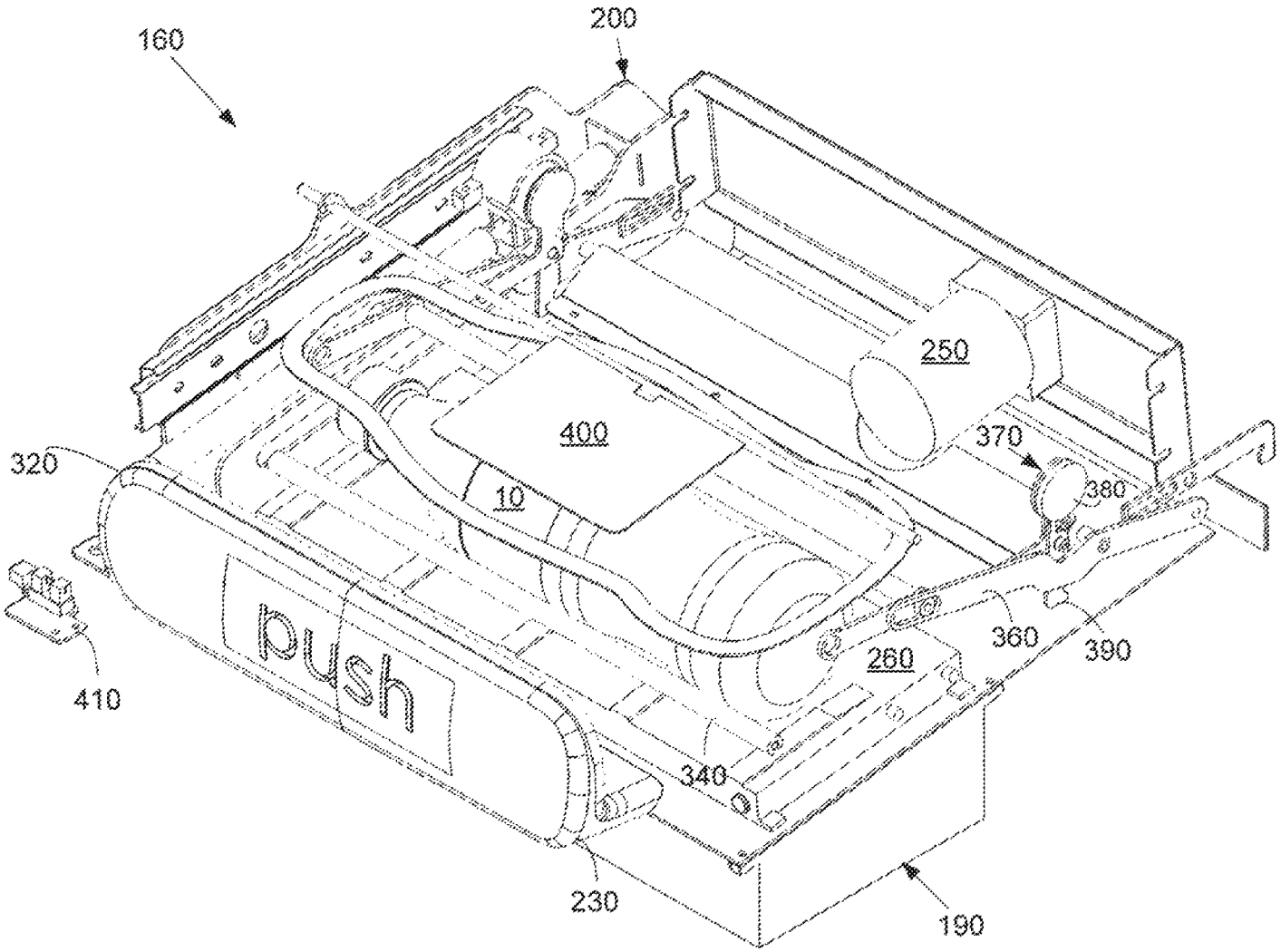
FIG. 9 is a partial perspective view of the intake mechanism of FIG. 2A in a "reject" mode.

FIG. 8 shows the intake mechanism 160 in a "mid-reject" mode. In this mode, the identification module 250 does not recognize the product 10 as an authorized product. As such, the input control device 370 turns off the magnet 380 such that the pawl 390 is disengaged. The reciprocating spring assembly 200 acts in a similar manner to that described above, but the pawl 390 does not engage the boss 265 of the refrigerator flap 260. As is shown in FIG. 9 in a "reject" mode, the product 10 remains on top of the refrigerator flap 260 as the reciprocating spring assembly 200 contracts and then again expands so as to return the product 10 to the input port 210 via the input rods 340, 350. The input rods 340, 350 still may swivel as described above, but the product remains on the closed refrigerator flap 260. Upon returning to the "ready" mode, the input rods 340, 350 will be re-positioned under the product 10. A user may then replace the rejected product 10 with a valid product 10.

The lights 215 of the intake mechanism 160 may be used to signal the different types of input modes. For example, the "ready" mode may be signaled by oscillation of the light output between about 50 to about 80 percent of output capacity over a given timeframe. An "identifying" mode may be signaled by a rapid oscillation of the light output. An "identified/verified" mode may be signaled by a full, constant light output. An "unidentified/reject" mode may be signal by turning the lights off. Many other modes and many other signal types may be used herein.

The intake mechanism 160 thus improves the overall energy efficiency of the merchandiser 100. Specifically, the intake mechanism 160 only opens the refrigerator flap 260 to the temperature controlled compartment 130 upon identification of an authorized product 10. Further, the intake mechanism 160 is manually operated without the use of electro-mechanical devices and controls and the associated energy drain. Moreover, the use of the gas spring 330 should make the intake mechanism 160 reliable over a long component lifetime.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof

We claim:

1. An intake mechanism configured to allow a product to be introduced into a merchandiser, the intake mechanism comprising:

a base with a refrigerator flap and a corresponding refrigerator port therein, the refrigerator flap having an open configuration and a closed configuration, wherein entry of the product to a temperature controlled compartment in the merchandiser via the refrigerator port is allowed when the refrigerator flap is in the open configuration;

a reciprocating spring assembly;

an input tray having an input port configured to receive the product, wherein the input tray is moveably mounted about the base via the reciprocating spring assembly;

an identification module configured to identify the product, the identification module being positioned adjacent the input port; and an input control system comprising a pawl operated by a magnet;

wherein once the identification module identifies a product placed into the input port as an authorized product, the product in the input tray is carried by the reciprocating spring assembly to the refrigerator flap which is activated by the input control system into the open configuration by engagement of the refrigerator flap by the pawl such that the product can enter the temperature controlled compartment of the merchandiser.

2. The intake mechanism of claim 1, wherein the input tray comprises one or more lights positioned about the input port.

3. The intake mechanism of claim 1, wherein the input tray comprises a push handle.

4. The intake mechanism of claim 1, wherein the reciprocating spring assembly comprises a gas spring.

5. The intake mechanism of claim 4, wherein the gas spring comprises a piston therein.

6. The intake mechanism of claim 1, wherein the reciprocating spring assembly comprises a plurality of input rod linkages in communication with a gas spring for movement therewith.

7. The intake mechanism of claim 6, wherein the reciprocating spring assembly comprises a pair of input rods in communication with the plurality of input rod linkages for movement therewith.

8. The intake mechanism of claim 7, wherein at least one of the pair of input rods swivel open and closed.

9. The intake mechanism of claim 1, wherein the input control system is positioned on the reciprocating spring assembly for movement therewith.

10. The intake mechanism of claim 1, wherein the pawl does not engage the refrigerator flap when the product is not identified by the identification module.

* * * * *